US009689253B2

(12) United States Patent
Rivero et al.

(10) Patent No.: US 9,689,253 B2
(45) Date of Patent: Jun. 27, 2017

(54) USE OF NANOTRACERS FOR IMAGING AND/OR MONITORING FLUID FLOW AND IMPROVED OIL RECOVERY

(71) Applicant: SCHLUMBERGER TECHNOLOGY CORPORATION, Sugar Land, TX (US)

(72) Inventors: Jose Antonio Rivero, Calgary (CA); Shad W. Siddiqui, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 444 days.

(21) Appl. No.: 14/186,851

(22) Filed: Feb. 21, 2014

(65) Prior Publication Data

US 2014/0231077 A1 Aug. 21, 2014

Related U.S. Application Data

(60) Provisional application No. 61/767,584, filed on Feb. 21, 2013.

(51) Int. Cl.
*E21B 47/10* (2012.01)
*E21B 43/24* (2006.01)

(52) U.S. Cl.
CPC ..... *E21B 47/1015* (2013.01); *E21B 43/24* (2013.01); *E21B 47/102* (2013.01)

(58) Field of Classification Search
CPC ..... E21B 43/16; E21B 43/24; E21B 47/1015; E21B 43/2401; E21B 47/00; E21B 47/102; E21B 47/122; G01V 3/30; G01V 3/26; G01V 3/00; G01V 3/02; G01V 3/20; C09K 2208/10; C09K 8/592
See application file for complete search history.

(56) References Cited

U.S. PATENT DOCUMENTS 4,875,015 A * 10/1989 Ward ..... G01V 3/26 324/323
5,151,658 A * 9/1992 Muramatsu ..... G01V 3/26 166/254.2
5,914,603 A * 6/1999 Daily ..... G01V 3/02 324/357
6,088,655 A * 7/2000 Daily ..... G01V 3/24 702/7
6,331,436 B1 12/2001 Richardson et al.
6,645,769 B2 11/2003 Tayebi et al.
(Continued)

FOREIGN PATENT DOCUMENTS

WO WO 2012005737 A1 * 1/2012 ..... G01V 3/30

OTHER PUBLICATIONS

Wang et al., "Rapidly Functionalized, Water-Dispersed Carbon Nanotubes at High Concentration", 2006, J. Am. Chem. Soc., vol. 128, p. 95-99.*

(Continued)

*Primary Examiner* — Daniel P Stephenson

(57) ABSTRACT

A method of monitoring a reservoir during an oil recovery process includes placing a plurality of electrodes proximate the reservoir, injecting a nanoparticle dispersion into the reservoir with an injection fluid, and recording a current measurement and a voltage measurement from the plurality of electrodes with an electronic control module during the oil recovery process.

20 Claims, 3 Drawing Sheets

(56) References Cited

U.S. PATENT DOCUMENTS

| | | | | |
|---|---|---|---|---|
| 8,638,104 | B2 * | 1/2014 | Barber | G01V 3/00 324/338 |
| 2006/0102345 | A1 * | 5/2006 | McCarthy | C09K 8/805 166/250.1 |
| 2009/0194333 | A1 * | 8/2009 | MacDonald | E21B 43/24 175/45 |
| 2009/0200016 | A1 * | 8/2009 | Goodwin | E21B 47/10 166/248 |
| 2011/0120702 | A1 * | 5/2011 | Craig | E21B 43/26 166/250.1 |
| 2011/0198078 | A1 * | 8/2011 | Harrigan | E21B 49/008 166/254.2 |
| 2011/0309835 | A1 * | 12/2011 | Barber | G01V 3/00 324/339 |
| 2013/0091941 | A1 * | 4/2013 | Huh | E21B 47/1015 73/152.08 |
| 2014/0231077 | A1 * | 8/2014 | Rivero | E21B 47/1015 166/250.12 |
| 2014/0367092 | A1 * | 12/2014 | Roberson | E21B 47/00 166/250.01 |
| 2015/0090456 | A1 * | 4/2015 | Turkenburg | G01V 9/00 166/305.1 |
| 2015/0159079 | A1 * | 6/2015 | Huh | G01V 3/26 166/248 |
| 2015/0192004 | A1 * | 7/2015 | Saeedfar | E21B 36/00 166/248 |
| 2016/0040514 | A1 * | 2/2016 | Rahmani | G01V 3/30 703/2 |

OTHER PUBLICATIONS

Asuha, et al., "Water-soluble, mesoporous Fe3O4: Synthesis, characterization, and properties", Ceramics International, 2012, pp. 1-6.
Butler, et al., "The effect of steam quality on the electrical behavior of steam-flooded sands: A laboratory study", Geophysics, vol. 60 (4), 1995, pp. 998-1006.
Daily, et al., "Chapter 17: Electrical Resistance Tomography—Theory and Practice", Near-Surface Geophysics Part 2: Applications and Case Histories, Society of Exploration Geophysicists, 2005, pp. 525-550.
Ganguly, et al., "Experimental investigation of the effective electrical conductivity of aluminum oxide nanofluids", Powder Technology, vol. 196, 2009, pp. 326-330.
Gual, et al., "Colloidal Ru, Co and Fe-nanoparticles. Synthesis and application as nanocatalysts in the Fischer-Tropsch process", Catalysis Today, vol. 183, 2012, pp. 154-171.
Lee, et al., "Effective viscosities and thermal conductivities of aqueous nanofluids containing low volume concentrations of Al2O3 nanoparticles", International Journal of Heat and Mass Transfer, vol. 51, 2008, pp. 2651-2656.
Nijland, et al., "Detection of soil moisture and begetation water abstraction in a Mediterranean natural area using electrical resistivity tomography", Catena, vol. 81, 2010, pp. 209-216.
Rassenfoss, S. , "Illuminating the Reservoir—Using Electromagnetic Waves to Track Oil and Water", Journal of Petroleum Technology, 2012, pp. 50-51.
Shokrlu, et al., "Effects of Nano Sized Metals on Viscosity Reduction of Heavy Oil/Bitumen During Thermal Applications", CSUG/SPE 137540—Canadian Unconventional Resources & International Petroleum Conference, Calgary, Alberta, Canada, Oct. 19-21, 2010, pp. 1-10.
Shokrlu, et al., "Transportation and Interaction of Nano and Micro Size Metal Particles Injected to Improve Thermal Recovery of Heavy-Oil", SPE 146661—SPE Annual Technical Conference and Exhibition, Denver, Colorado, 2011, pp. 1-12.
Siddiqui, et al., "The effect of stabilizer addition and sonication on nanoparticle agglomeration in a confined impinging jet reactor", Colloids and Surfaces A: Physicochemical and Engineering Aspects, vol. 350, 2009, pp. 38-50.
Tondel, et al., "Remote reservoir monitoring in oil sands: From feasibility study to baseline datasets", World Heavy Oil Congress (WHOC 12-231), 2012, pp. 1-4.
Viguie, et al., "Study of agglomeration of alumina nanoparticles by atomic force microscopy (AFM) and photon correlation spectroscopy (PCS)", Colloids and Surfaces A: Physicochemical Engineering Aspects, vol. 302, 2007, pp. 269-275.
Wong, et al., "Transport properties of alumina nanofluids", Nanotechnology, vol. 19, 2008, pp. 1-8.
Xie, et al., "Thermal conductivity enhancement of suspensions containing nanosized alumina particles", Journal of Applied Physics, vol. 91 (7), Apr. 1, 2002, pp. 4568-4572.
Zhu, et al., "Preparation and characterization of porous y-Zl203 nanoparticles", Materials Letters, vol. 83, 2012, pp. 73-75.
"Steam Assisted Gravity Drainage (SAGD)", the Oil Sands Developers Group, 2009, http://web.archive.org/web/20121017161642/http://www.oilsandsdevelopers.ca/index.php/oil-sands-technologies/in-situ/the-process-2/steam-assisted-gravity-drainage-sagd, 1 page.
"Generic Representation of the Displacement Process in Steamflooding", Image, http://petrolerosdebarinas.blogspot.ca, Oct. 17, 2012, 1 page.

* cited by examiner

USE OF NANOTRACERS FOR IMAGING AND/OR MONITORING FLUID FLOW AND IMPROVED OIL RECOVERY

CROSS-REFERENCE TO RELATED APPLICATION

This application claims the benefit of U.S. Provisional Patent Application Ser. No. 61/767,584 filed on Feb. 21, 2013, entitled "Use of Nanotracers for Imaging and/or Monitoring Fluid Flow and Improved Oil Recovery," which is incorporated by reference herein in its entirety.

BACKGROUND

As the supply of conventional oil dwindles, heavy oil and bitumen are expected to become an increasingly important source of fuel. Heavy oil and bitumen are typically produced using thermal recovery methods that rely on the injection of fluids such as steam and hot water. Steam or hot water is injected into a reservoir creating a steam chamber in the formation. The steam chamber will transfer its heat to the reservoir including any reservoir fluid (for example, heavy oil and bitumen). As the temperature of the reservoir fluid rises, the viscosity of the reservoir fluid decreases, allowing the heated reservoir fluid to flow and be extracted from the reservoir. As the heating of the reservoir fluid relies heavily on the effectiveness of the steam chamber, monitoring the movement of the injected fluid through the reservoir during thermal operations is useful for managing and maximizing heavy oil production in reservoirs.

Several techniques including, electromagnetics (EM) and electric resistance tomography (ERT), have been used to image the presence and location of rock, oil, water and other phases within the reservoirs. ERT is used to image various phases in heavy oil reservoirs. The ERT technique involves measuring a subsurface distribution of electrical conductivity by taking resistance measurements from electrodes placed in a geometric pattern. These electrodes may be placed on the surface and/or sub-surface of a reservoir. However, the images produced with ERT techniques are subject to measurement error and noise due to the reservoir environment and electrical contact resistance between the electrodes, the reservoir and the injected liquid.

SUMMARY

In one aspect, embodiments disclosed herein relate to a method of monitoring a reservoir during an oil recovery process that includes placing a plurality of electrodes proximate the reservoir, injecting a nanoparticle dispersion into the reservoir with an injection fluid, and recording a current measurement and a voltage measurement from the plurality of electrodes with an electronic control module during the oil recovery process.

In another aspect, embodiments disclosed herein relate to a method of imaging a reservoir during oil recovery using electric resistance tomography that includes placing a plurality of electrical resistance tomography electrodes proximate the reservoir, preparing a nanoparticle dispersion of a conductive nanopowder in deionized water, injecting the nanoparticle dispersion into the reservoir with an injection fluid, recording a current measurement and a voltage measurement from the plurality of electrodes with an electronic control module, processing the current measurements and voltage measurements to obtain resistivity values, and creating a graphical image of the reservoir using the resistivity measurement with the electronic control module.

In another aspect, embodiments disclosed herein relate to a method of monitoring fluid flow and improving oil recovery that includes placing a plurality of electrodes proximate the reservoir, increasing a conductivity of an injection fluid by adding a nanoparticle dispersion to the injection fluid, injecting the injection fluid having the nanoparticle dispersion into the reservoir, recording a current measurement and a voltage measurement from at least four of the plurality of electrodes, and producing a graphical image using the current measurement and the voltage measurement.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

In the following detailed description of embodiments, numerous specific details are set forth in order to provide a more thorough understanding. However, it will be apparent to one of ordinary skill in the art that the disclosed subject matter of the application may be practiced without these specific details. In other instances, well-known features have not been described in detail to avoid unnecessarily complicating the description. Additionally, in the Figures, like numbers denote the same things.

Figure 1:
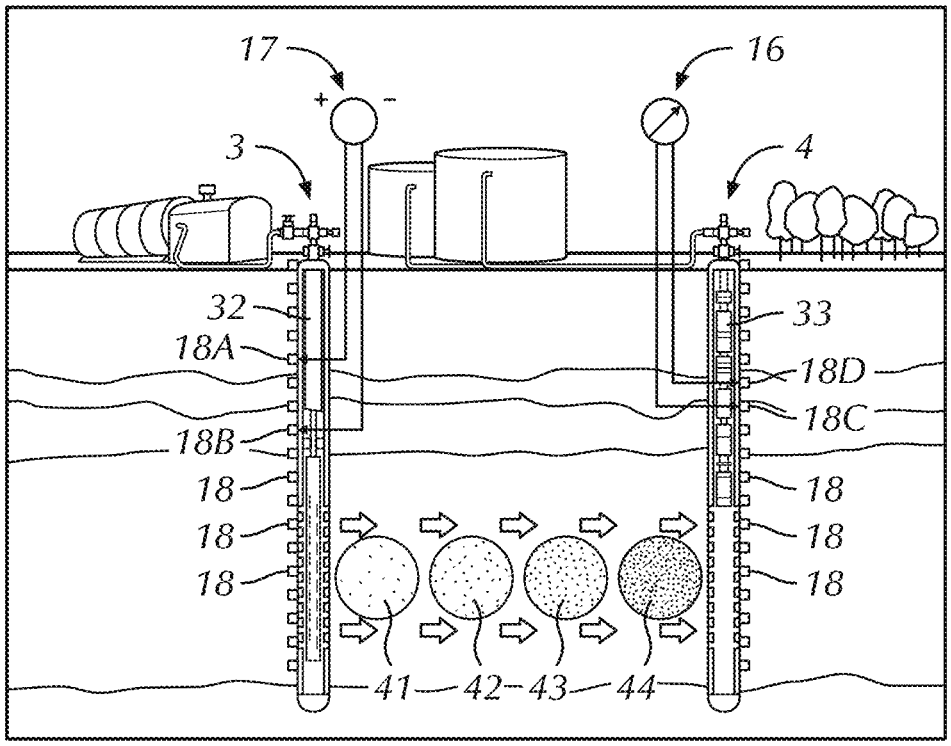
FIG. 1 shows a schematic of dual string injection and electric resistance tomography arrangement in accordance with embodiments of the present disclosure.

In steam injection heavy oil recovery, electric resistance tomography (ERT) imaging may be used to monitor the progress of the steam and heavy oil during injection and oil recovery. ERT relies on the relative conductivity of various phases of matter to produce an image. FIG. 1 illustrates a dual well steam injection process for heavy oil recovery. An array or plurality of electric resistive tomography electrodes 18 may be placed at the surface, subsurface, or in at least one of the wells. An injection fluid may be pumped via injection pump 3 through injection well 32 into the reservoir. An injection fluid may refer to steam, hot water, or any fluid used to heat heavy oil known in the art.

As noted above, ERT imaging relies on measuring the electrical resistance between electrodes. For example, in the context of steam injection during oil recovery, the changes in resistivity between the virgin and steamed zones in the reservoir can be measured and inverted. Then an image can be created. The quality of the ERT image is sensitive to, for example, porosity, pore connectivity and conductivity of pore fluids. Successful data acquisition and image quality may depend on the minimization of the contact resistance at the interface between the pore, water and the electrode. Thus, minimizing the contact resistance between the electrodes, the reservoir environment and fluid is desirable.

According to embodiments of the present disclosure, the conductivity of injected fluids may be enhanced by adding a conductive tracer-fluid (i.e., a fluid used to track the flow of fluid in the reservoir) to the injection stream. For example, a conductive nanoparticle dispersion may be injected with the injection fluid to act as a tracer-fluid. A conductive nanoparticle dispersion, may include a fluid or emulsion having conductive (i.e., metallic) nanoparticles suspended therein. By increasing the conductivity of the fluid injected downhole, the contact resistance between the electrodes, the reservoir environment may be reduced. For simplicity, as used herein, nanoparticle dispersion is intended to refer to a conductive nanoparticle dispersion.

The nanoparticle dispersion may be prepared using ultrasonication by exposing conductive nanopowders (for example conductive-polymers, metal or metal oxides etc.) in distilled water to sound energy at ultrasonic frequencies. In some examples, the conductive nanopowders can be made of conductive polymers, metals or metal oxides. Other conductive nanopowders can be used. One having ordinary skill in the art will understand that the nanoparticle dispersion may be prepared according to other methods of preparing nanoparticles known in the art, for example chemical reduction, electrochemical reduction, microemulsion technique, sonochemical method, phase inversion, flash evaporation and many other techniques. Nanopowders may include, for example iron (Fe), nickel (Ni), alumina ($Al_2O_3$), iron oxide ($Fe_3O_4$), copper (Cu), copper oxide (CuO), zinc oxide (ZnO), conductive polymeric materials or any other conductive nanopowder known in the art.

Nanodispersion of a known concentration can be prepared by dispersing a 'known' quantity of nanopowder in a 'known' quantity of distilled water. According to embodiments of the present specification, a concentration between approximately 0.01% and 1% (volume fraction) is desired to increase the conductivity of the injection fluid, but the optimum value can be estimated by lab/field experiments and/or modeling study. If the nanoparticle dispersion is too concentrated, then the nanoparticle dispersion may be diluted with deionized water. If the nanoparticle dispersion is too dilute, the dispersion may be concentrated under by well-known centrifugation process.

The nanoparticle dispersion may be injected into the reservoir with the injection fluid with pump 3. The nanoparticle dispersion may comprise typically between 0.01% and 1% (volume fraction) but optimum value could only be estimated by lab/field experiments and/or modeling study of the total volume of fluid injected downhole, while the injection fluid comprises the remaining volume. One having ordinary skill in the art will understand that the ratio of nanoparticle dispersion to injection fluid pumped downhole may be adjusted during the course of the oil recovery process.

The injection fluid will enter the reservoir 1 via tubing 32. The injection of the fluid may create a region of steam and condensed water 41 in the reservoir. The region of steam and condensed water 41 may heat the reservoir fluid (i.e., bitumen). For example, at the beginning of the injection, the reservoir may include at least four regions: region 41 having steam and condensed water, region 42 having hot water or steam, region 43 having an oil bank, and region 44 having an oil and water zone near original reservoir temperature. Although shown as discrete regions in FIG. 1, one having ordinary skill in the art will understand that the regions may overlap and change in relative size and shape with respect to each other as the recovery process progresses. Due to their size, the nanoparticles may travel through the reservoir with the injected fluid, thereby heating the reservoir fluid. As the injection of fluid continues, the hot water region 42 will progressively heat the oil bank region 43 causing the temperature of the oil in regions 43 and 44 to rise. Some of the water or steam in the injection fluid may mix with the oil and form emulsions. The heated oil will have a reduced viscosity which will allow the oil to be recovered through the production well 33.

In order to monitor the oil recovery process using graphical images, electric resistance tomography (ERT) may be utilized. In ERT, a plurality of electrodes operatively coupled to an electronic control module (ECM) measures the electric resistivity of the reservoir throughout the oil recovery process. FIG. 1 shows an ERT configuration in accordance with embodiments of the present disclosure. A plurality of electrodes 18 are disposed at the surface and in wells 32 and 33. During and following injection, a current may be supplied to the electric resistive tomography electrodes 18 coupled to a current supply 17 and a voltage measurement may be taken with the electric resistive tomography electrodes 18 coupled to a voltmeter 16. One having ordinary skill in the art will understand that the electrodes may be placed at the surface, subsurface or in a well without departing from the scope of the present disclosure.

Figure 4:
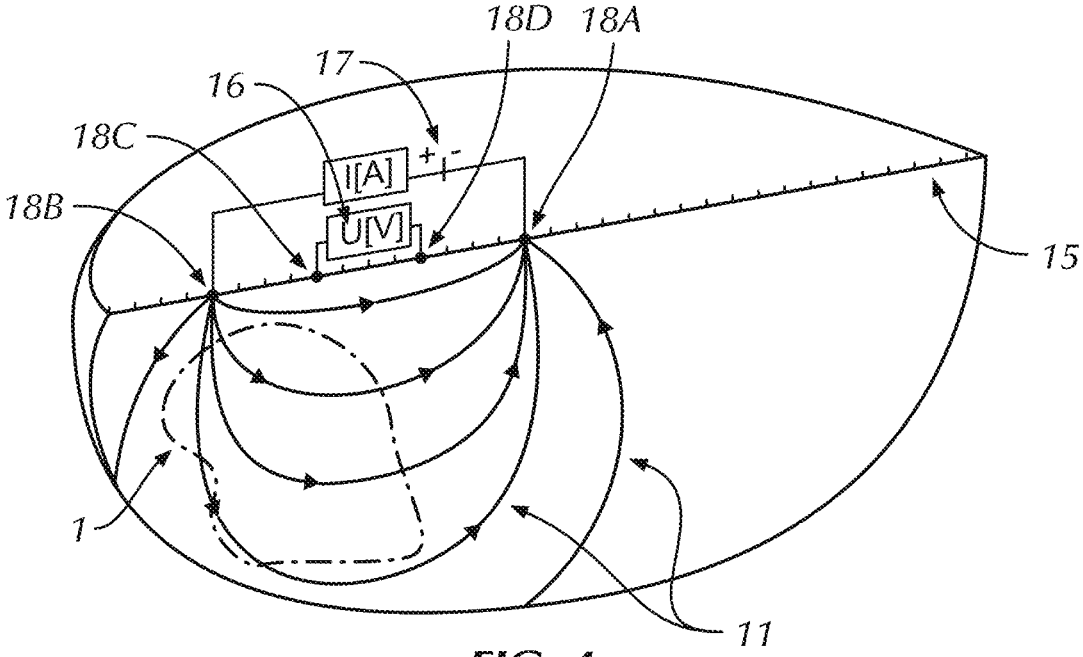
FIG. 4 shows an arrangement of electrodes in accordance with embodiments of the present disclosure.

FIG. 4 shows an example of an electrode array having four electrodes in accordance with embodiments of the present disclosure. It is noted that embodiments may have any number of electrodes. Tests done by the applicants have included 32 electrodes per well, and the present disclosure contemplates including more than 32. FIG. 4 shows four electrodes disposed on a surface of a reservoir 1. One having ordinary skill in the art will understand that the number of electrodes is not intended to limit the scope of the present disclosure.

For descriptive purposes, two electrodes 18A, 18B shown operatively coupled to a current source 17 and two electrodes 18C, 18D are shown operatively coupled to a voltmeter 16. A current source may include, for example a direct current or commutated direct current source, or any current source known in the art. One having ordinary skill in the art will understand that any two electrodes 18 may form an electrode pair and be operatively coupled to the voltmeter 16 and the current source 17. This allows multiple measurements of the same reservoir to be taken. For example, according to an embodiment of the present disclosure electrodes 18A and 18C may be coupled to the current source 17, while electrodes 18B and 18D are operatively connected to the voltmeter 16. In other words, each linear combination of the plurality of electrodes 18 may be used to take a multiple measurements of the same reservoir. This may produce a more complete image of the reservoir and reduce measurement errors. The configuration of the electrode pairs is not intended to limit the scope of the present disclosure.

In FIG. 1, the current source 17 provides a current 11 that flows between electrodes 18A and 18B. The current may be in the range of 1 to 5 amperes, although one having ordinary skill in the art would understand that the current supplied is not intended to limit the scope of the disclosure. As the current 11 flows from electrode 18A through the ground and the reservoir to electrode 18B, a potential difference is experienced between electrodes 18A and 18B as well as throughout the reservoir. This potential difference may be measured by electrodes 18C and 18D, which are operatively coupled to voltmeter 16. As noted above, using four electrodes reduces measurement errors associated with contact resistance.

Although FIG. 1 shows the plurality of electrodes 18 arranged in two lines corresponding to boreholes 32 and 33, one having ordinary skill in the art may understand that the position of the plurality of electrodes 18 relative to each other and the reservoir is not meant as a limitation on the scope of the present disclosure. For example, the electrodes 18 may be arranged in a geometric three-dimensional pattern. In another example, the electrodes 18 may not be uniformly spaced from one another. In another example the electrodes 18 may not be linearly arranged.

Figure 2:
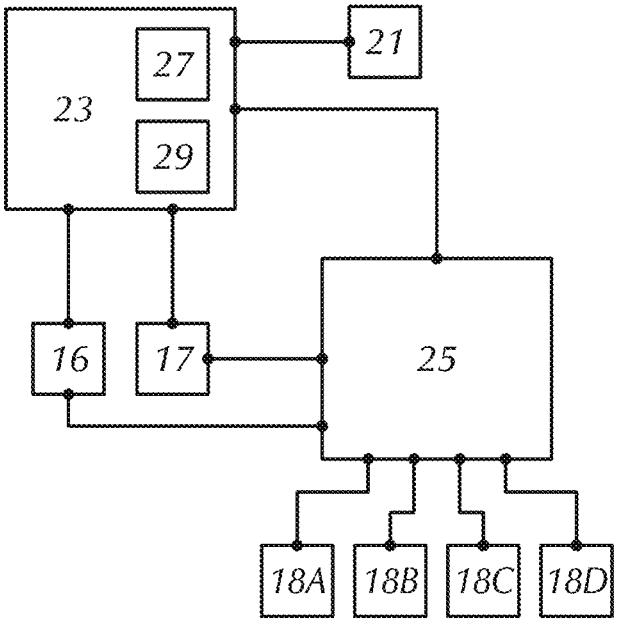
FIG. 2 shows a schematic of a control module for monitoring heavy oil recovery in accordance with embodiments of the present disclosure.

Referring to FIG. 2, according to embodiments of the present disclosure, the electrodes 18A, 18B, 18C, 18D, current source 17, and voltmeter 16 may be operatively coupled to an electronic control module 23 (ECM). The ECM 23 may include processing circuitry 27, a memory unit 29, a power source 21. The processing circuitry 27 may acquire, send and process data to and from the electrodes 18A, 18B, 18C, 18D, current source 17 and voltmeter 16. The memory unit 29 may store instructions for the electrodes and data acquired from the electrodes. For example, the memory unit 29 may store instructions on when and how to take the voltage measurements; while the processing circuitry 27 may send instructions to the current source 17 to provide a current to electrodes 18A, 18B and instructions to voltmeter 16 to take a measurement from electrodes 18C, 18D. This measurement may then be stored in the memory unit 29. The processing circuitry 27 may send instructions to take the measurements at regular intervals.

According to some embodiments of the present disclosure, the ECM may also be responsible for configuring the electrode pairs. For example, after a first measurement is taken in the configuration shown in FIG. 1 (i.e., electrodes 18A, 18B coupled to current source 17 and electrodes 18C, 18D coupled to voltmeter), the ECM may reconfigure the electrode pairs (i.e., electrodes 18A, 18C coupled to current source 17 and electrodes 18B, 18D coupled to voltmeter). The reconfiguration may be performed with, for example, a multiplexer 25 operatively coupled to the ECM 23 as shown in FIG. 2. For example, assuming an initial configuration as shown in FIG. 1, the processing circuitry 27 may instruct the multiplexer 25 to disconnect at least electrode 18B from the current source 17 and at least electrode 18C from the voltmeter 16 and then connect at least electrode 18B to the voltmeter 16 and at least electrode 18C to the current source 17. One having ordinary skill in the art will understand that the multiplexer 25 may be capable of operatively connecting and disconnecting more than one electrode 18 at a time.

By taking multiple measurements of the reservoir with various electrode pair configurations, more data may be accumulated for further processing to produce a more complete image of the reservoir. Specifically, the processing unit 27 may convert the voltage and current measurements to a resistivity value using Ohm's law. The resulting resistivity measurements may then be used to produce a graphical image using, for example computer software.

According to embodiments of the present disclosure, the graphical images produced may be used to modify the injection of fluid into the reservoir. For example, if the graphical images indicate that the steam chamber is sufficiently large and/or effectively heating the reservoir fluid, then the percentage of the nanoparticle dispersion being injected downhole with the injection fluid may decrease. In another example, if the graphical images indicate that the steam chamber is not effectively heating the reservoir fluid, then the percentage of the nanoparticle dispersion being injected downhole with the injection fluid may increase. In another example, if the graphical images indicate that the steam chamber is sufficiently large and/or effectively heating the reservoir fluid, volume and/or pressure of injection fluid pumped down injection well 32 may be reduced. In another example, if the graphical images indicate that the steam chamber is not effectively heating the reservoir fluid, then the volume and/or pressure of injection fluid pumped down injection well 32 may be increased. In another example, if the graphical images indicate that the steam chamber is not sufficiently large and multiple injection wells are being used, the steam injection can be concentrated on areas where the steam chamber is not very large. In another example, if the if the graphical images indicate that the steam or hot water chamber is not heating certain parts of the reservoir, the wellbore completion 32 could be modified to force hot fluids injection into un-swept or poorly-swept parts of the reservoir.

According to one aspect, improved oil recovery may also be achieved using embodiments of the present disclosure. Referring again to FIG. 1, an array of electrical resistance tomography electrodes may be placed proximate the reservoir. Next, the conductivity of an injection fluid may be increased by adding a nanoparticle dispersion to the injection fluid. The nanoparticle dispersion may include metal, metal oxides or some other conductive nanoparticle known in the art, for example Fe, Ni, $Al_2O_3$, and $Fe_3O_4$. By adding the particles of the nanoparticle dispersion the thermal conductivity of the injection fluid is enhanced.

Figure 5:
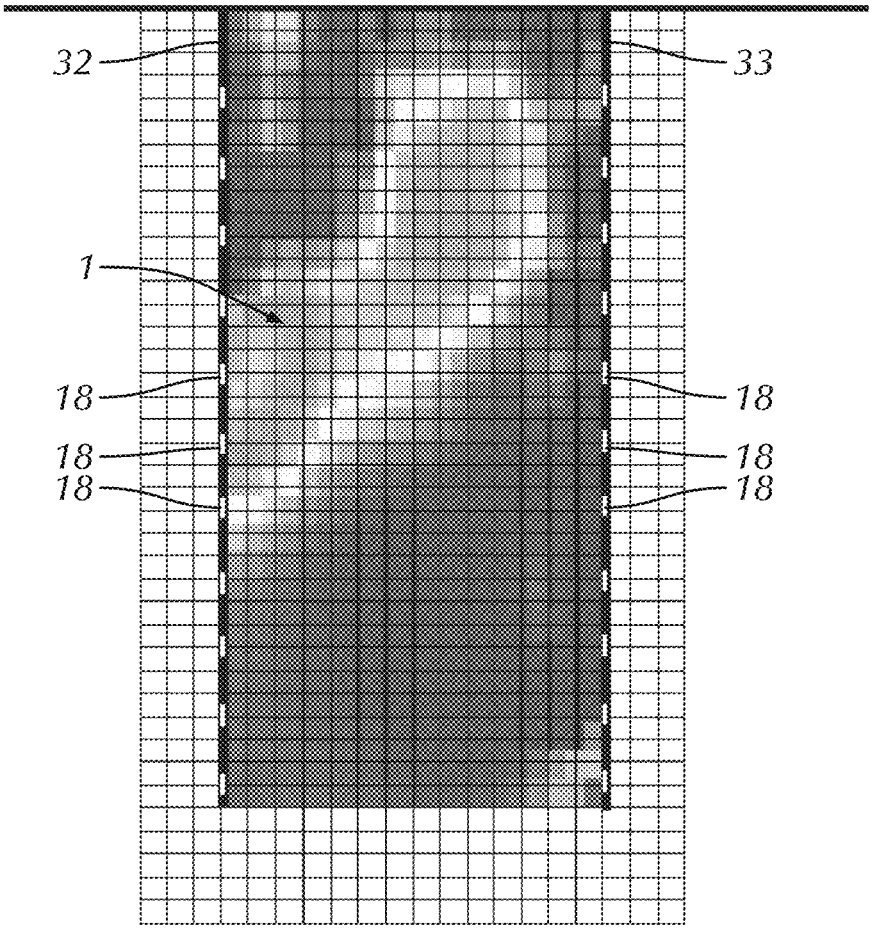
FIG. 5 shows a graphical image of a reservoir using electric resistance tomography in accordance with embodiments of the present disclosure.

Next, the injection fluid including the nanoparticle dispersion may be injected into the reservoir. Due to the increase in thermal conductivity of the nanoparticle dispersion the heat transfer from the injection fluid to the heavy oil is improved. During and following injection, a current and voltage measurement may be recorded from at least four of the plurality of electrodes. Measuring the current and voltage from the plurality of electrodes may be repeated at various times during the oil production process. A graphical representation of the measurements may then be produced using, for example, finite element analysis methods as seen in FIG. 5. As the images are representative of the reservoir at a particular time, repeating the measurements at various stages of oil production allows the user to monitor the progression of the injection fluid through the reservoir during production.

Figure 3:
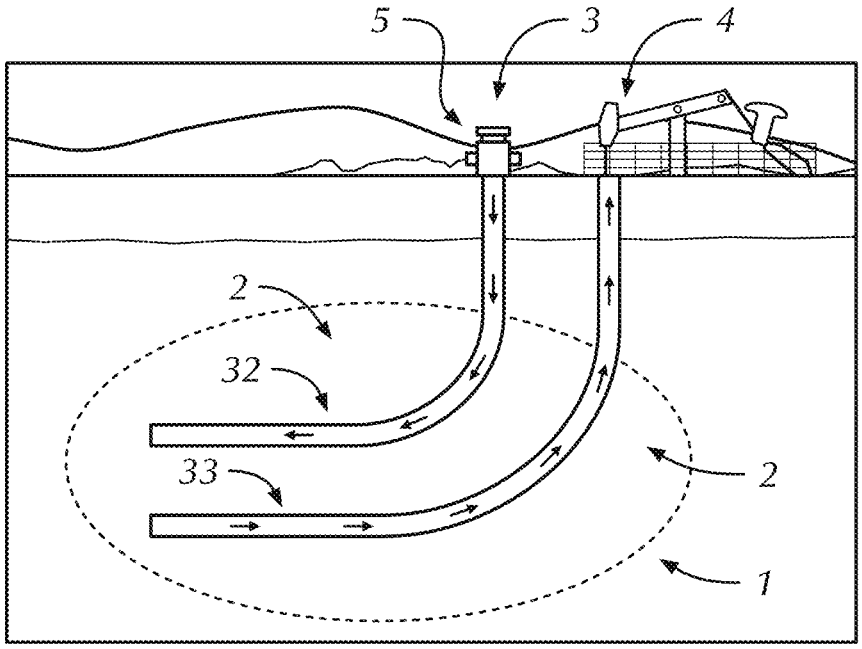
FIG. 3 shows a cross-section of a dual string injection process in accordance with embodiments of the present disclosure.

Although the oil recovery process has been shown and described with respect to a dual string injection process, one having ordinary skill in the art will understand that a configuration of other injection processes may be used without departing from the scope of the present application. Referring to FIG. 3, a dual string injection process is shown where at least a portion of the wells 32 and 33 are at an angle, for example, horizontal, with respect to the surface. Other examples of oil recover processes include, a multi-string injection process may be used having at least two injection wells or at least two production wells. Embodiments of the present disclosure may also be used with a single well injection process. Further, the wells may be substantially vertical as seen in FIG. 1 or have at least a portion of the well at an angle or substantially horizontal with respect to the surface, as seen in FIG. 3. Thus, one having ordinary skill in the art will understand that the number of wells used for oil recovery and the orientation of the well is not intended to limit the scope of the present application.

According to embodiments of the present disclosure various electrode configurations may be implemented without departing from the scope of the disclosure. Referring to FIG. 4, an electrode array is shown in accordance with embodiments of the present disclosure. As used herein, the term "electrode array" may be used to refer to a plurality of electrodes. The electrode array has four electrodes 18A, 18B, 18B, and 18C disposed at the surface 15 of a reservoir 1. For instructive purposes the electrodes shown are in pairs, where electrodes 18A and 18B may be operatively connected to a current source 17 and electrodes 18C and 18D may be operatively connected to a voltmeter 16. However, one having ordinary skill in the art will understand that any two electrodes may be used to form an electrode pair operatively connected to the voltmeter 16 or the current source 17.

As shown in FIG. 4, the current source 17 provides a current 11 that flows between electrodes 18A and 18B. As the current 11 flows from electrode 18B through the ground and the reservoir to electrode 18A, a potential difference is experienced between electrodes 18A and 18B. This potential difference may be measured by electrodes 18C and 18D, which are operatively coupled to voltmeter 16.

Although the electrodes 18A, 18B, 18C and 18D are shown as being arranged in a line, one having ordinary skill in the art will understand that the arrangement of the electrodes is not intended to limit the scope of the present disclosure. For example, the electrodes may be arranged in a plane at the surface, subsurface, and/or in a borehole or in a three dimensional arrangement (i.e., not in the same plane) at the surface, subsurface, and a borehole.

As described above with respect to FIGS. 1 and 2, the ECM 23 may provide the instructions to the current supply 17 and voltmeter 16 to take the necessary measurements with electrodes 14. Referring again to FIG. 2, the current source 17 may provide current to at least two electrodes 18A and 18B operatively coupled to the current source 17. Meanwhile at least two electrodes 18C and 18D operatively coupled to voltmeter 16 may measure the potential difference between the two electrodes operatively coupled to the current source 17. The electrode pairs may be reconfigured multiple times such that process of providing current and measuring the potential difference is performed by all linear combinations of four electrodes from the plurality of electrodes 18A-18D are exhausted. The ECM 23 may compile and process this data to render a graphical image of the reservoir at a particular point in time. The process of taking measurements with electrode pairs, reconfiguring the electrode pairs, processing the data and rendering an image may be repeated over the course of the oil recovery process to monitor the reservoir.

Although only a few example embodiments have been described in detail above, those skilled in the art will readily appreciate that many modifications are possible in the example embodiments, without materially departing from this invention. For example, although the methods described herein are directed to monitoring heavy oil recovery, one of ordinary skill in the art would understand that the methods may be used in other applications, for example, environmental monitoring, mapping earth resources, groundwater movement and detecting caves and voids. Accordingly, all such modifications are intended to be included within the scope of this disclosure as defined in the following claims. Moreover, embodiments disclosed herein may be practiced in the absence of any element which is not specifically disclosed.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method of monitoring a reservoir during a thermal oil recovery process comprising:

placing a plurality of electrodes proximate the reservoir;

injecting a metallic nanoparticle dispersion into the reservoir with an injection fluid to heat heavy oil in the reservoir; and recording a current measurement and a voltage measurement from the plurality of electrodes with an electronic control module during the thermal oil recovery process after injecting the metallic nanoparticle dispersion into the reservoir with the injection fluid.

2. The method of claim 1, further comprising preparing the nanoparticle dispersion from at least one of a conductive nanopowder.

3. The method of claim 2, wherein the conductive nanopowder includes at least one of iron, nickel, a conductive polymeric material, or a metal oxide of alumina, zinc, or copper.

4. The method of claim 2, wherein the preparing further comprises subjecting the at least one metal or metal oxide to ultrasonication.

5. The method of claim 1, further comprising measuring a concentration of the nanoparticle dispersion prior to injecting.

6. The method of claim 5, further comprising diluting the nanoparticle concentration with deionized water.

7. The method of claim 1, wherein the nanoparticle dispersion has a concentration between 0.01% and 1% by volume fraction.

8. The method of claim 1, further comprising converting the current and voltage measurements into a resistivity values and producing a graphical image based on the resistivity values.

9. A method of imaging a reservoir during a thermal oil recovery process using electric resistance tomography, the method comprising:

placing a plurality of electrical resistance tomography electrodes proximate the reservoir;

preparing a nanoparticle dispersion of a conductive nanopowder in deionized water;

injecting the nanoparticle dispersion into the reservoir with an injection fluid to heat heavy oil in the reservoir;

recording a current measurement and a voltage measurement from the plurality of electrodes with an electronic control module;

processing the current measurements and voltage measurements to obtain resistivity values; and using electric resistance tomography to create a graphical image of the reservoir using the resistivity measurement with the electronic control module.

10. The method of claim 9, further comprising automatically recording the current and voltage measurements periodically with an electronic control module.

11. The method of claim 10, comprising operatively connecting a first pair of electrodes of the plurality of electrodes to a current source and operatively connecting a second pair of electrodes of the plurality of electrodes to a voltmeter.

12. The method of claim 11, comprising:

disconnecting the first pair of electrodes from the current source;

disconnecting the second pair of electrodes from the voltmeter;

operatively connecting a third pair of electrodes of the plurality of electrodes to a current source;

operatively connecting a fourth pair of electrodes of the plurality of electrodes to a voltmeter; and recording a current measurement and a voltage measurement from the third pair of electrodes and fourth pair of electrodes with an electronic control module.

13. The method of claim 12, wherein the disconnecting the first pair, disconnecting the second pair, operatively connecting the third pair, operatively connecting the fourth pair, and recording is repeated until each linear combination of four electrodes of the plurality of electrodes is exhausted.

14. The method of claim 10, wherein the injecting the nanoparticle dispersion is performed using a dual tube injection process.

15. The method of claim 10, comprising repeating the recording, inverting and creating a graphical image.

16. The method of claim 10, further comprising modifying the injecting based on the graphical image.

17. The method of claim 9, wherein the conductive nanopowder includes at least one of iron, nickel, a conductive polymeric material, or a metal oxide of alumina, zinc, or copper.

18. A method of monitoring fluid flow and improving oil recovery in a reservoir during a thermal oil recovery process, the method comprising:

placing a plurality of electrodes proximate the reservoir;

increasing a conductivity of an injection fluid by adding a conductive nanoparticle dispersion to the injection fluid;

injecting the injection fluid having the nanoparticle dispersion into the reservoir to heat heavy oil in the reservoir;

recording a current measurement and a voltage measurement from at least four of the plurality of electrodes after injecting the injection fluid; and producing a graphical image using the current measurement and the voltage measurement.

19. The system of claim 18, wherein the injection fluid comprises at least one selected from steam or water.

20. The method of claim 18, wherein the recording a current measurement and a voltage measurement from the electrodes is repeated.

* * * * *